US006767404B2

(12) United States Patent
Krohmer

(10) Patent No.: US 6,767,404 B2
(45) Date of Patent: Jul. 27, 2004

(54) GLUING STATION FOR ADHESIVE BINDING BLOCKS OF PAPER

(75) Inventor: Matthias Krohmer, Hülben (DE)

(73) Assignee: bielomatik Leuze GmbH + Co. KG (DE)

( * ) Notice: Subject to any disclaimer, the term of this patent is extended or adjusted under 35 U.S.C. 154(b) by 0 days.

(21) Appl. No.: 10/346,692

(22) Filed: Jan. 16, 2003

(65) Prior Publication Data

US 2003/0131945 A1 Jul. 17, 2003

(30) Foreign Application Priority Data

Jan. 17, 2002 (DE) ..... 102 02 588

(51) Int. Cl.[7] ..... B05C 1/02

(52) U.S. Cl. ..... 118/244; 118/259; 156/574; 156/578; 412/8; 412/37

(58) Field of Search ..... 118/244, 259; 156/574, 578; 412/8, 37

(56) References Cited

U.S. PATENT DOCUMENTS 4,335,674 A 6/1982 Winker et al.

5,605,575 A * 2/1997 Anderson ..... 118/679

FOREIGN PATENT DOCUMENTS

| | | | |
|---|---|---|---|
| DE | 1 486 748 | A | 7/1969 |
| DE | 119 555 | A | 5/1976 |
| GB | 2 198 990 | A | 6/1988 |
| WO | WO-00/69651 | A1 | 11/2000 |

* cited by examiner

*Primary Examiner*—Laura Edwards
(74) *Attorney, Agent, or Firm*—Akerman Senterfitt

(57) ABSTRACT

A gluing station for adhesive binding sheet blocks with clamping fixtures for localizing a sheet block with a glue application device, which provides at least one glue application roller that is moveable relative to a block spine by a carriage. Moveable tightening fixtures for slanting the block spine are provided, and the carriage is arranged on a linear carriage track that is inclined at least nearly parallel to the slanted alignment of the block spine. The gluing station may be used for adhesive bindings of books, brochures and other printed products.

11 Claims, 4 Drawing Sheets

GLUING STATION FOR ADHESIVE BINDING BLOCKS OF PAPER

Figure 1:
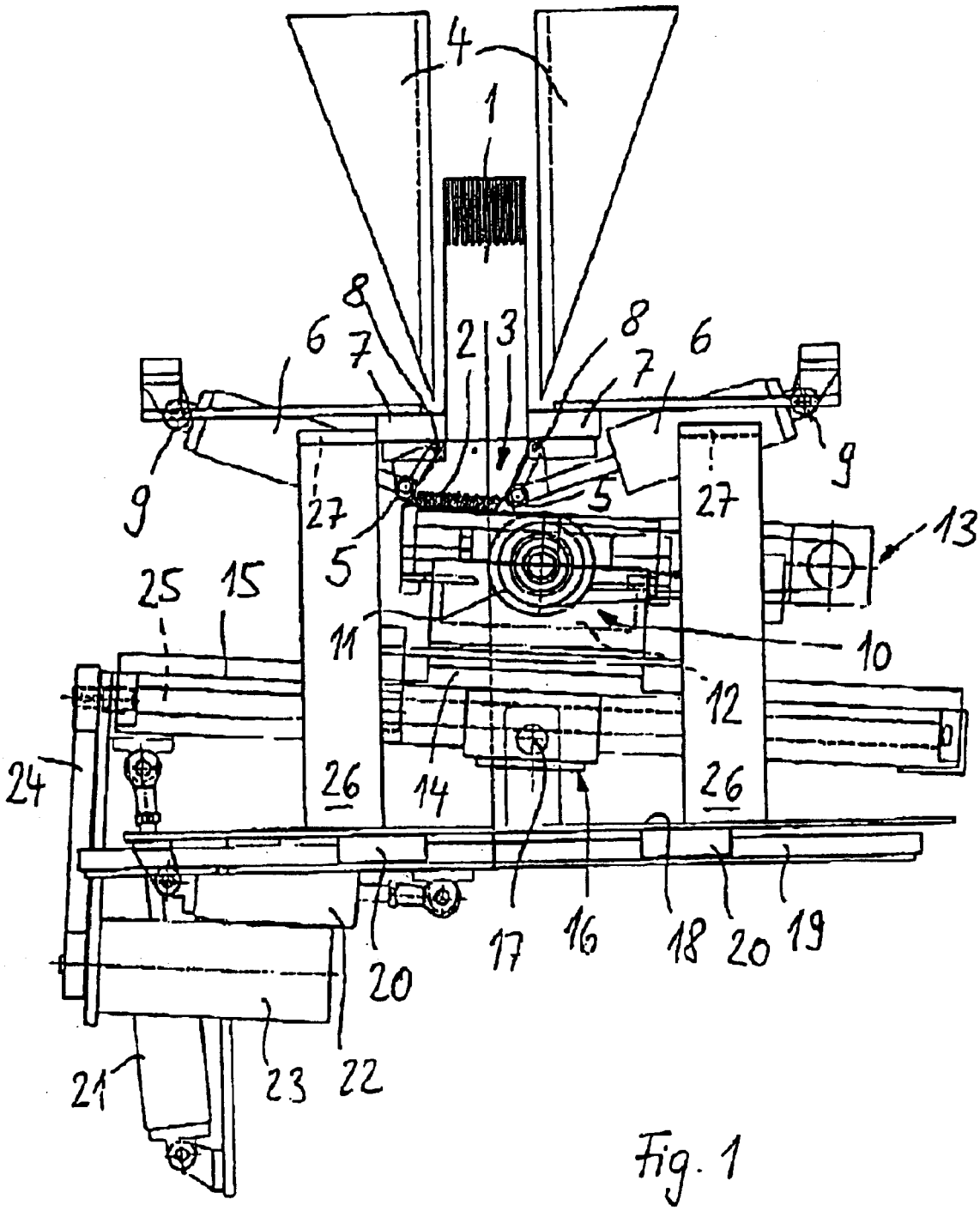

The invention concerns a gluing station for the adhesive binding of sheet blocks with clamping fixtures for localizing the sheet block as well as with a glue application device that at least provides a glue application roller that is movable relative to a block spine by means of a carriage.

Such a gluing station is known from DT 1486748. The gluing station is provided with clamping jaws between which a sheet block is localized such that a lower block section with a block spine to be glued protrudes freely downward. A glue application device is coordinated to the block spine that provides a roller set that is positioned in a glue container that applies the glue to the block spine. The roller set comprises two extremely rapidly rotating rollers that rotate counter-directionally to each other.

A process and an apparatus for double-fan adhesive-binding books, book bodies, brochures and the like is known from WO 00/69651 A1 that encompass two different embodiments.

A first embodiment provides a glue pad that acts on the block spines that is set into a swinging motion by means of a crank control. In a second embodiment the glue pad is rocked and subsequently milled or kneaded using a mobile table.

The task of the invention is to create a gluing station of the type mentioned at the outset that achieves a secure and long-lasting adhesive bond with simple means.

This task is solved in that movable tightening fixtures for buckling the block spine are provided and that the carriage is arranged on a linear carriage track that is tilted at least nearly parallel to the slant alignment of the block spine. By slanting the block spine the sheet edges of the block spine are automatically pushed against each other by a small amount and as such fanned out. Each sheet edge is moistened with glue not only on the face side but also over the slightly fanned out strains in that at least one roller moves parallel along the fanned block spine by means of the carriage. The at least nearly parallel alignment means that the carriage and subsequently at least the one glue application roller can also be moved linear relative to the block spine in a small attack angle of less than 5°.

In the embodiment of the invention the clamping fixtures localize the sheet block such that a block section provided with the block spine to be glued protrudes from the clamping device loosely able to be fanned at a defined length of preferably at least 50 mm. This protruding block section can therefore be buckled on the side desired and subsequently slanted causing the block spine to fan out, i.e. the slight shift of all the edges relative to each other.

In another embodiment of the invention the tightening fixtures grab opposing outer sides of the protruding block section of the sheet block by means of securing jaws that squeeze at least the respective outer side of the sheet block. The tightening fixtures are preferably equipped with linear actuators that are connected in their front face areas to the coordinated securing jaws. The result is that the loose block section can be buckled and subsequently slanted with particularly simple and yet reliable means. In addition to the outer side, in many embodiments the pages beneath it are also squeezed.

In another embodiment of the invention at least one linear actuator is aligned at an acute angle relative to the adjacent outer side of the sheet block in the direction of the block spine. This enables tension to be exerted onto at least one of the two outer pages defining the outer sides of the sheet block as well as on the respective sheets located underneath as necessary, which prevents the respective outer sheet, which serves as the end, as well as the respective sheets located underneath from welling.

In another embodiment of the invention the tightening fixtures are movable such that the block spine can be positioned into two oppositely inclined slanted positions. The tightening fixtures are subsequently able to buckle the protruding open block section into a slanted position in both the one as well as the other direction. This way it is possible to apply glue to the sheet edges first on one side—and after turning over—on the other side. When turned over to the other side the glue of each sheet edge applied on the first side is automatically already applied to the respective other side of the adjacent sheet edge.

In another embodiment of the invention the carriage track is attached on a seesaw to tip such that the carriage track can be aligned to the various slanted positions of the block spine. Depending on the alignment and realization of the slant of the block spine the carriage track is also repositioned to enable reliable glue application.

In another embodiment of the invention a drive is attached to the glue application roller by means of which the glue application roller is drivable in various-rotational directions. In a preferred embodiment of the invention only one single glue application roller is provided. Thanks to the optional counter or co-rotation of the glue application roller a variety of different effects can be achieved. When the glue application roller is run counter-directional, the sheet edges of the block spine are also mechanically deformed. This makes it possible to mushroom the block spine, which is desirable for many types of adhesive bindings.

In another embodiment of the invention a seesaw bearing a carriage track is arranged on a horizontally movable adjusting platform. The ability of the adjusting platform to move horizontally makes it possible to adjust the carriage track and subsequently the glue application to sheet blocks of various thickness.

In another embodiment of the invention an alignment device is attached to the adjusting platform that matches the horizontal path of the adjusting platform to differences in the thickness of different sheet blocks. The alignment device detects the respective thickness of the sheet block clamped in by the clamping fixtures and moves the adjusting platform such that in any case the glue application roller comes into contact with the block spine. The feature of the adjusting platform as well as the alignment device provides the benefit that neither the carriage track nor the carriage or the glue application roller require additional adjustment in order to achieve certain glue application with any sheet block thickness.

In another embodiment of the invention the alignment device provides a bracket stop on both sides of the sheet block that is permanently connected with the adjusting platform that is positioned to the height of the sheet block and is attached to the sheet block or a component attached to the sheet block. This is a particularly simple and yet reliable option for aligning the carriage track and subsequently the glue application roller exactly to the respective clamped sheet block and thus always achieving certain glue application.

Other benefits and features of the invention are stated in the claims as well as in the following description of a preferred example embodiment of the invention, which is shown in the drawings.

Figure 2:
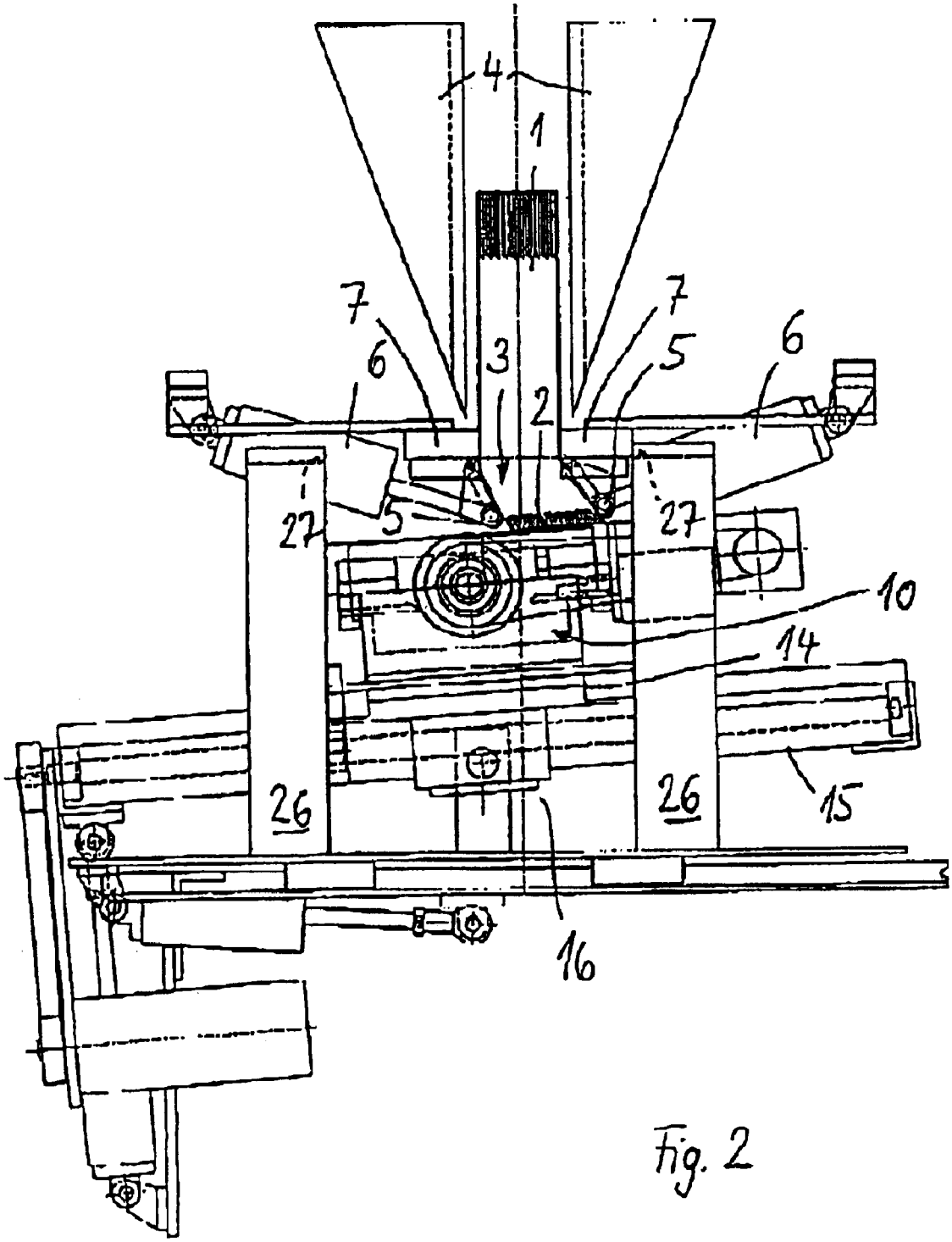
Figure 3:
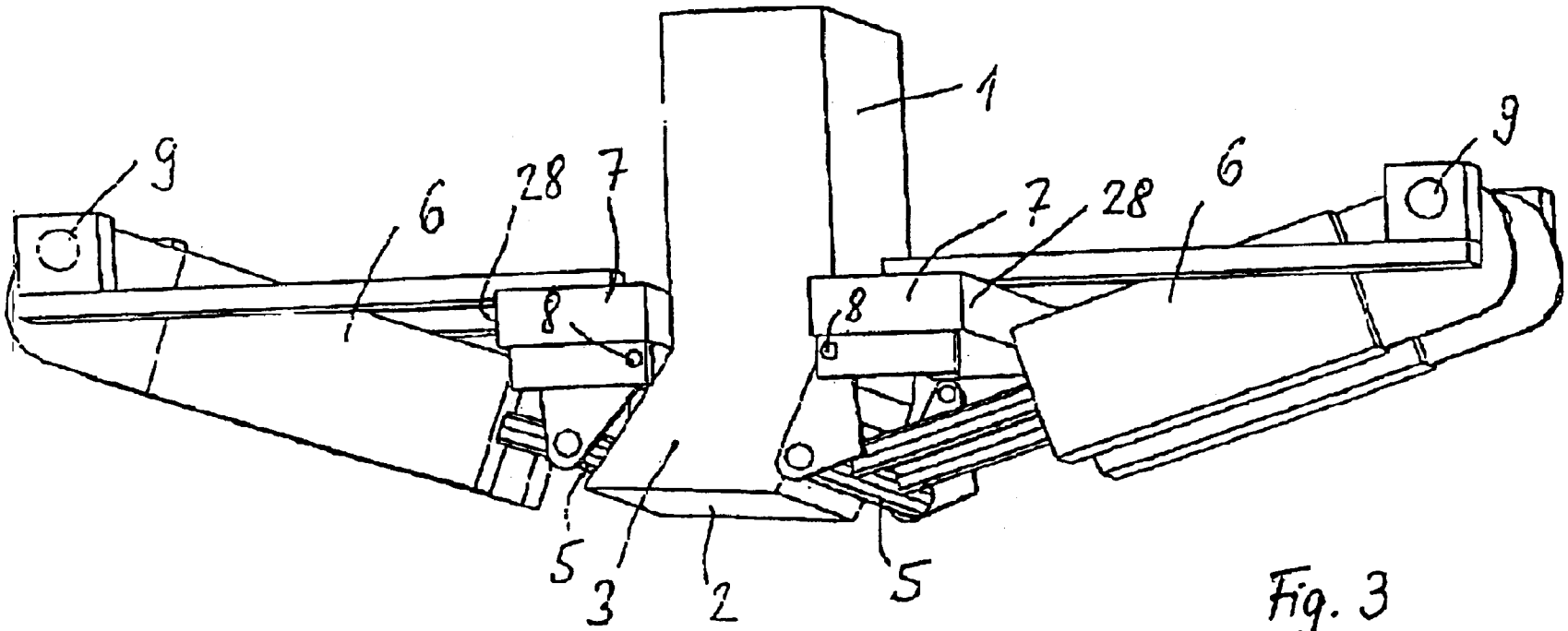
Figure 4:
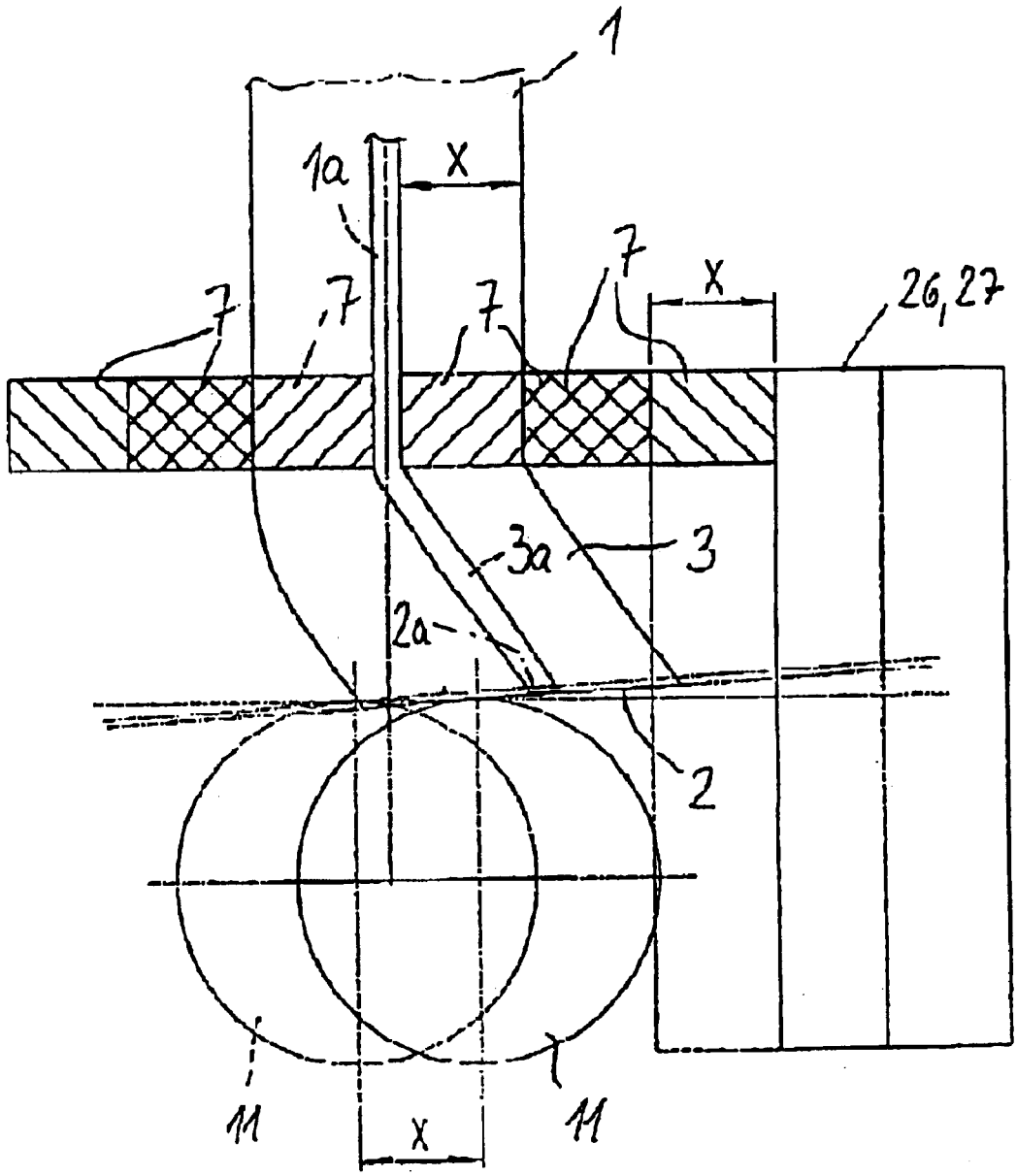

FIG. 1 shows an embodiment of an inventive gluing station in which a protruding open block section of the sheet block to be bound is buckled to the left, FIG. 2 shows the gluing station of FIG. 1, wherein the block section is buckled to the right, FIG. 3 shows an enlarged perspective view of a section of a gluing station according to FIGS. 1 and 2 in the area of movable tightening fixtures, which slant the open block of the sheet block, and FIG. 4 shows an enlarged schematic view of the different positioning of individual components of the gluing station of FIGS. 1 through 3 in sheet blocks of various thickness to be bound.

A gluing station of FIGS. 1 through 4 is used to create adhesive bindings in sheet blocks for books, brochures or similar printed products produced in smaller edition.

For localizing a sheet block in the form of a sheet pile to the gluing station, guide and clamping fixtures 4 are provided that together with other clamping fixtures in the form of jaws 7 vertically align the respective sheet block 1 such that a block spine 2 to be provided with adhesive binding is provided on the underside of the vertically aligned sheet block 1. The clamping fixtures 7,4 localize the sheet block 1 in the vertically aligned position such that below the jaws 7 a lower open block section 3 of the sheet block 1 protrudes downward. The block spine 2 forms the underside of the protruding open block section 3. In the example embodiments shown the loading and localization of each sheet block 1,1*a* that ends up in the gluing station are designed such that the open block section 3,3*a* that protrudes downward from the jaws 7 provides a defined length here of 70 mm.

The block section 3 protruding downward underneath the clamping jaws 7 is slanted by tightening fixtures 5, 6 in preparation of the gluing as represented in FIG. 1. As can be seen in FIG. 3 in particular the tightening fixtures provide securing jaws 5 on the one hand that are directly pressed onto opposing outer sides of the block section 3 and subsequently onto the opposing outer sheets. On the other hand linear actuators 6 are provided by means of which the securing jaws 5 can be pressed against the respective outer side of the block section 3 or removed from it.

The clamping jaws 7 are attached to be able to slide to a frame of the glue station, which is not described in more detail here, for both releasing the sheet block 1 and clamping it. The linear actuators, which are designed here as tension cylinders 6, are also mounted to the frame. The tension cylinders 6 are positioned on opposite sides of the block section 3 and each is connected with a localization jaw 5 that grabs each outer side of the block section 3. Each localization jaw 5 is designed essentially cylindrical in the example embodiment shown here and runs parallel to the outer plane of the sheet block 1. In a way not described in more detail here the tension cylinders 6 are provided with drivers in the form of pneumatic, hydraulic or electric units. A main control unit of the gluing station that features other control components described in more detail below is the control source.

Each localization jaw 5 is suspended by means of two bearing straps in the area of the guide axle 8 on the assigned clamping jaw 7 as per FIG. 3. The tension cylinders 6 are suspended swayable to a bracket 9 at their ends opposite the respective securing jaws 5. The bracket 9 is part of the frame of the gluing station. As can be seen clearly in FIG. 3 the tension cylinders 6 together with the cylinder rods of the bracket 9 bearing the securing jaws 5 each protrude diagonally downward such that the motional plane of the tension cylinders runs at an acute angle to the vertical and subsequently to the sheet plane of the sheet block in the unbuckled state of the block section 3.

As can be seen in FIGS. 1 through 4 a diagonal alignment of the block section 3 automatically causes the horizontal slant alignment of the block spine 2, which is formed by the bottom edges of the sheet block 1. This automatically causes a certain fanning of the sheet in the area of the block spine, i.e. each sheet edge shifts a slight amount towards the adjacent sheet edge. In each sheet this causes a small part of the side area to appear above the sheet edge. In addition to the sheet edges these form the area used for glue application that later leads to the mutual adhesion of adjacent sheets in the area of the block spine when the block section 3 is put returned to the vertical position.

Because the tightening fixtures 5,6 can grab the outer sides of the block section 3 in an acute angle using compression load, pressure is exerted downward particularly onto the outer side of the page, which is curved in the same direction, in the projected plane of FIG. 3 onto the right outer side of the page, which causes the corresponding outer sheet of the sheet block 1 to be tightened downward. Some of the sheets underneath are tightened as well. This safely prevents undesired welling of the outside sheet as well as the sheets below it.

In order to effectuate consistent glue application to the slanted block spine 2 of FIG. 1, a glue application device 10 is provided that can be slid in a linear direction by means of a carriage 14 on a carriage track 15.

The carriage track 15 is aligned nearly parallel to the slanted block spine 2 such that the carriage 14 bearing the glue application device 10 is mounted movable linear parallel to the sheet block and subsequently parallel to the underside sheet edges of the sheet block 1. In this example embodiment the nearly parallel alignment means that the carriage 14 is moved linear at an attack angle of 2° relative to the block spine.

The glue application device 10 is provided with a glue application roller 11 that is revolvable and powered by a drive 13 that is movable along the block spine 2 for glue application on such block spine 2. The glue application roller 11 partially protrudes into a glue bath 12, which is part of the glue application device 10. The thickness of the glue application picked up by the glue application roller by respective rotation can be adjusted by means of suitable coaters, which are not described in more detail here.

In the example embodiment of FIG. 1 presented, the glue application roller rotates counter-clockwise such that it coats directionally along the sheet edges of the sheet spine. Therefore, the coater shown in FIG. 1 on the right side of the glue application roller is in its functioning position. The opposite coater is distanced from the sheath of the glue application roller 11 and subsequently is in its resting position.

The carriage track 15 is positioned at a slant parallel to the block spine 2. The tension cylinders 6 are controlled by means of the central control unit such that the open block section 3 is slanted to the point that a defined slant alignment of the block spine 2 results. The control unit accordingly also aligns the carriage track at a slant based on control settings such that parallel alignment to the block spine 2 is achieved. For tilting it the carriage track 15 is attached to a seesaw 16 at its middle point, which defines a swivel axis 17 for the carriage track 15. The swivel axis 17 runs parallel to a rotational axis of the glue application roller 11. An adjustment cylinder 21 grabs the carriage track 15 on a left side in FIG. 1 that effects the slant position desired by teetering the carriage track 15 on the seesaw 16.

The carriage 14 is movable linear on the carriage track 15 by means of a spindle drive 25. An electric motor 23 is used as the drive for the spindle drive 25 that is connected with the spindle drive 25 by means of a synchronous belt drive 24.

The seesaw 16 is fastened on an adjusting platform 18 that is mounted movable by means of linear guides 20 relative to the stationary guide track 19 on the frame side. A drive device, in the form of an adjusting cylinder 22 here, that is hinged both stationary and to an adjusting platform 18 causes horizontal movements of the adjusting platform 18. Rigidly fastened to the adjusting platform 18 are connecting rods 26 that protrude vertically upward and that end at the level of the clamping jaws 7. The connecting rods 26 each provide a bracket stop 27 on top that protrudes perpendicularly inward, i.e. towards their respective tension cylinders 6, which interact with the backside stop surfaces 28 of the clamping jaws 7. The column-like connecting rods 26 are arranged on the side beyond the trajectory of the carriage 24 such that the movement of the carriage 14 is not obstructed by said connecting rods 26. The clamping jaws 7 protrude outward on at least one side as per FIG. 3 laterally over the width of the sheet block 1 to create the respective stop surface 28 for the corresponding bracket stop 27.

The connecting rods 26 and subsequently also the bracket stops 27 are opposed on the adjusting platform 18 such that when the respective support rod 27 is attached to the arranged clamping jaws 7 the carriage 14 and subsequently also the glue application roller 11 are automatically positioned such that the glue application roller effects application of glue when moved past the block spine 2. The plane of the block spine and the tangential plane to one sheath topside of the glue application roller 11 therefore are at least largely identical.

As can be seen in FIG. 4 the bracket stops 27, which are rigidly connected with the adjusting platform by means of connecting rods 26, in tandem with the horizontal mobility of the adjusting platform 18 form an automatic resetting arrangement for the gluing station that effectuates automatic, correct alignment of the glue application roller 11 relative to the respective block spine 2,2*a*, regardless of the actual thickness of the respective sheet block 1,1*a*. Because if a sheet block 1 that is substantially thinner compared to the sheet block 1*a* is localized by clamping fixtures 4,7 and the open block section 3 that protrudes downward provides the same length of 70 mm as the open length of the block section 3 of the thick sheet block 1, when the block section 3*a* is slanted parallel to the alternatively loadable sheet block 1, the block spine 2*a* will be aligned parallel above the plane of the block spine 2 by a few millimeters. If the glue application roller 11 would stay in its position where it was for gluing the block spine 2 of the thick sheet block 1, then the glue application roller 11 would not be able to make contact with the block spine 2*a* such that a glue application would not occur either. Thanks to the automatic readjustment of the glue application roller 11, by which the entire adjusting platform 18 is moved by a differential X between the thick sheet block 1 and the thin sheet block 1*a*—viewed relative to a median lengthwise plane identical for both sheet blocks 1,1*a*—the same alignment of the glue application roller 11 is automatically achieved for the thinner sheet block 1*a* that the glue application roller 11 had for the thicker sheet block 1 before. Since the motional plane of the glue application roller 11 increases analogous to the inclined carriage track the result for the sheet block 1 relative to the previous slanted path of motion of the glue application roller 11 is a slight displacement as per the dashed lines of FIG. 4, which effectuates certain glue application even with the thinner sheet block 1*a*. The appropriate calibration to the displaced level of the block spine 2*a* is amazingly achieved by means of simple horizontal displacement of the entire glue application device. The adjusting platform 18 is moved horizontally until the bracket stop 27 of the assigned connection rod 26 at the stop surface 28 of the assigned clamping jaws 7 again moves onto block. This path of motion corresponds exactly to the differential X described above and explained in FIG. 4.

In order to glue the respective block spine 2,2*a*, the glue application roller 11 is preferably moved at least once along the block spine 2, which according to FIG. 1 is aligned to the left, and finally at least once along the block spine 2 now aligned to the right as per FIG. 2. The result is both a transposition of the block section 3 by means of the tension device 5,6 and a transposition of the carriage 14 to the respective counter-tipped slant position of the carriage track 15 between both gluing processes.

In order additionally to mushroom the block spine 2, it is possible to drive the glue application roller 11 counter-directionally relative to the direction of motion of the carriage 14 and the direction of slant of the block spine 2. In this case the sheet edges become mechanically deformed when the rotating glue application roller 11 is passed by in the opposite direction of the slant direction of the block spine 2, which also causes the edges to slightly bend. These necessarily lead to the block spine becoming thicker and subsequently the desired mushrooming.

The main control unit coordinates all drives of the different moving components of the gluing station described above to ensure proper glue application.

What is claimed is:

1. A gluing station for the adhesive binding of sheet blocks comprising:

clamping fixtures for localizing a sheet block;

a glue application device that at least provides a glue application roller that is movable relative to a block spine by a carriage; and movable tightening fixtures for buckling the block spine, wherein the carriage is arranged on a linear carriage track that is aligned transverse to the block spine and tilted at least nearly parallel to the slant alignment of the block spine.

2. A gluing station according to claim 1, wherein the clamping fixtures localize the sheet block such that a block section provided with the block spine to be glued protrudes from the clamping fixtures loosely able to be fanned at a defined length of preferably at least 50 mm.

3. A gluing station according to claim 1, wherein the tightening fixtures grab opposing outer sides of the protruding block section of the sheet block by means of securing jaws that squeeze at least the respective outer side of the sheet block.

4. A gluing station according to claim 3, wherein the tightening fixtures are provided with linear actuators that are connected in their front face area with the coordinated securing jaws.

5. A gluing station according to claim 4, wherein at least one linear actuator is aligned at an acute angle relative to the adjacent outer side of the sheet block in the direction of the block spine.

6. A gluing station according to claim 1, wherein the tightening fixtures are movable such that the block spine can be positioned into two oppositely inclined slanted positions.

7. A gluing station according to claim 1, wherein the carriage track is attached on a seesaw to tip such that the carriage track can be aligned to the various slanted positions of the block spine.

8. A gluing station according to claim 1, wherein a roller drive is assigned to the at least one glue application roller, by means of which the glue application roller can be driven in different directions.

9. A gluing station according to claim 7, wherein the seesaw bearing the carriage track is arranged on a horizontally movable adjusting platform.

10. A gluing station according to claim 9, wherein an alignment device is attached to the adjusting platform that matches the horizontal path of the adjusting platform to differences in thickness of different sheet blocks.

11. A gluing station according to claim 10, wherein the alignment device provides a bracket stop on both sides of the sheet block that is permanently connected with the adjusting platform that is positioned to the height of the sheet block and is attachable to the sheet block or a component attached to the sheet block.

* * * * *